US005091197A

United States Patent [19]

Ferro et al.

[11] Patent Number: 5,091,197

[45] Date of Patent: Feb. 25, 1992

[54] TEA BAG WITH SQUEEZING DEVICE

[76] Inventors: Rosemary Ferro, 85-12 115th St., Richmond Hills, N.Y. 11418; Donald Williams, 124-13 97th Ave., Basement Apt., Richmond Hill, N.Y. 11419

[21] Appl. No.: 535,545

[22] Filed: Jun. 8, 1990

[51] Int. Cl.[5] ..... B65B 29/04; B65D 85/00

[52] U.S. Cl. ..... 426/80; 426/83; 206/0.5

[58] Field of Search ..... 426/80, 83; 206/0.5

[56] References Cited

U.S. PATENT DOCUMENTS

| | | | |
|---|---|---|---|
| 2,308,241 | 1/1943 | Hogaboom | 426/80 |
| 2,406,137 | 8/1946 | Eaton | 426/83 |
| 2,458,169 | 1/1949 | Irmscher | 426/83 |
| 2,606,836 | 8/1952 | McCabe | 426/80 |
| 2,614,934 | 10/1952 | Trotman | 426/83 |
| 2,728,672 | 12/1955 | Young et al. | 426/80 |
| 2,793,954 | 5/1957 | Nelson et al. | 426/83 |
| 2,800,408 | 7/1957 | Fimple | 426/80 |
| 2,869,718 | 1/1959 | Whelan | 426/83 |
| 2,895,598 | 7/1959 | Whelan | 426/83 |
| 2,986,269 | 5/1961 | Goldberg | 426/80 |
| 3,047,397 | 7/1962 | Irmscher | 426/80 |
| 3,057,729 | 10/1962 | Grant | 426/80 |
| 3,092,242 | 6/1963 | Irmscher | 426/80 |
| 3,237,550 | 3/1966 | Christopher | 426/80 |
| 3,387,978 | 6/1968 | Major | 426/80 |
| 3,550,528 | 12/1970 | O'Neill | 426/80 |
| 3,861,284 | 1/1975 | Costello | 426/80 |
| 3,895,118 | 7/1975 | Rambold | 426/80 |
| 4,153,153 | 5/1979 | Herzog | 426/83 |
| 4,250,990 | 2/1981 | Casper | 426/80 |
| 4,415,597 | 11/1983 | Romagnoli | 426/83 |
| 4,726,956 | 2/1988 | Christie | 426/80 |
| 4,735,810 | 4/1988 | Dacal | 426/80 |

*Primary Examiner*—Steven Weinstein
*Attorney, Agent, or Firm*—Richard L. Miller

[57] ABSTRACT

A tea bag with a squeezing device is provided and consists of a string attached at one end to an infusion bag with a quantity of ground tea leaves sealed therein. A cover being of two panels is joined together along a fold line and has a hole at the center of the fold line. The string passes through the hole with a tag attached to the other end of the string. The panels of the cover can be used to squeeze the infusion bag to extract infusion liquid from the bag and as a disposable structure therefore after said infusion bag is used.

1 Claim, 1 Drawing Sheet

TEA BAG WITH SQUEEZING DEVICE

BACKGROUND OF THE INVENTION

The instant invention relates generally to beverage infusion packages and more specifically it relates to a tea bag with a squeezing device.

Numerous beverage infusion packages have been provided in the prior art that are adapted to be fabricated with structures so that the packages when wet can be squeezed to drain their surplus contents. For example, U.S. Pat. Nos. 3,387,978 to Major; 3,550,528 to O'Neill; 4,726,956 to Christie and 4,735,810 to Dacal all are illustrative of such prior art. While these units may be suitable for the particular purpose to which they address, they would not be as suitable for the purpose of the present invention as hereafter described.

SUMMARY OF THE INVENTION

A primary object of the present invention is to provide a primary object of the present invention is to provide a tea bag with a squeezing device that will overcome the shortcomings of the prior art devices.

Another object is to provide a tea bag with a squeezing device with a slideable cover to be used in squeezing and residual liquid from the tea bag.

An additional object is to provide a tea bag with a squeezing device in which the slideable cover will serve as a protective structure for a fresh tea bag prior to use and as a disposable structure therefore after the tea bag is used.

A further object is to provide a tea bag with a squeezing device that is simple and easy to use.

A still further object is to provide a tea bag with a squeezing device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 4:
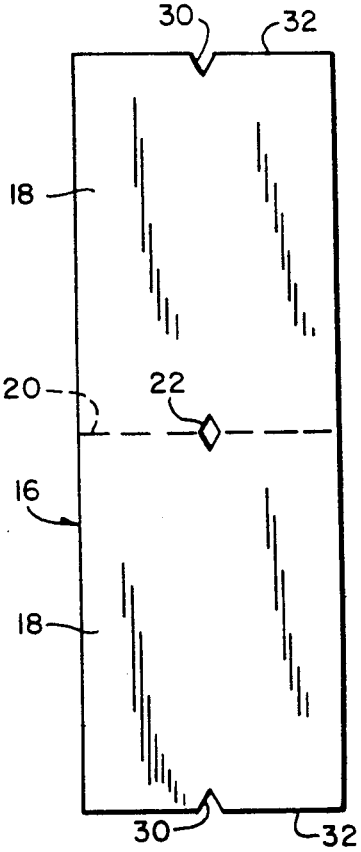
FIG. 4 is a flat open view of the cover per se.
Figure 5:
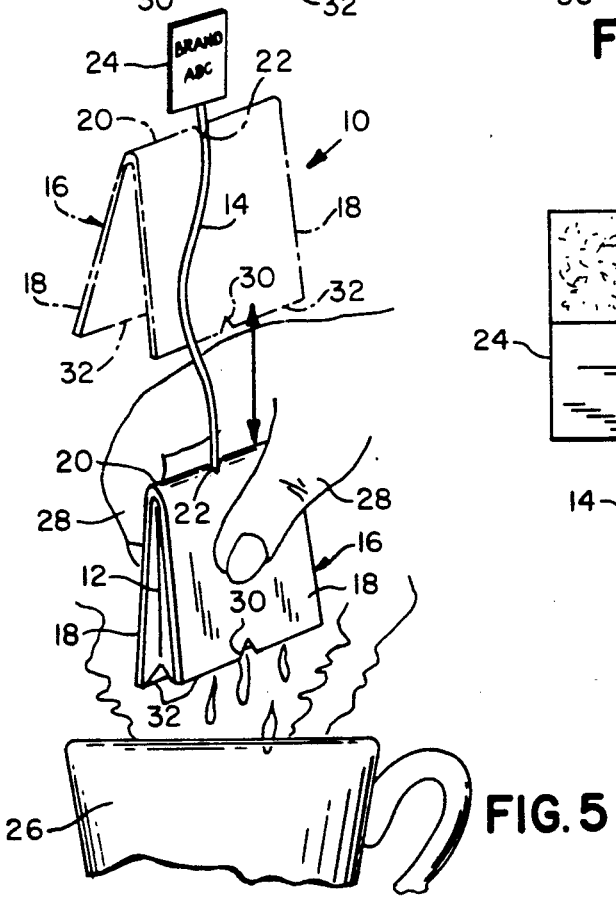
FIG. 5 is a perspective view of the instant invention in use.

Turning now descriptively to the drawings, in which like reference characters denote like elements throughout the several views, FIGS. 1, 2, 3, and 5 illustrates a tea bag with a squeezing device 10 consisting of an infusion bag 12 made of thermoseal filter paper capable of allowing water to filter therethrough, with a quantity of ground tea leaves sealed within the bag 12. A string 14 is attached at one end to the bag 12. A cover 16, as best seen in FIG. 4, consists of two panels 18 joined together along a fold line 20 and has a hole 22 at the center of the fold line 20 with the string 14 passing through the hole 22.

A tag 24 is attached to the other end of the string 14, whereby the cover 16 can slide on the string 14 towards the tag 24 thus allowing the infusion bag 12 to be inserted into a cup 26 with water. The cover 16 can also slide on the string 14 towards and onto the infusion bag 12 allowing the panels 18 to be used to squeeze the infusion bag 12 therebetween to extract infusion liquid from the bag 12.

The cover 16 is typically fabricated out of a light, resilient polystyrene foam plastic sheet, known as the trademark name of "STYROFOAM ®", that will not absorb the liquid and which will insulate the fingers 28 from the infusion bag 12 when the bag is steaming hot. Each panel 18 of the cover 16 is rectangular in shape so as to be of a size to completely fit over the infusion bag 12.

Figure 1:
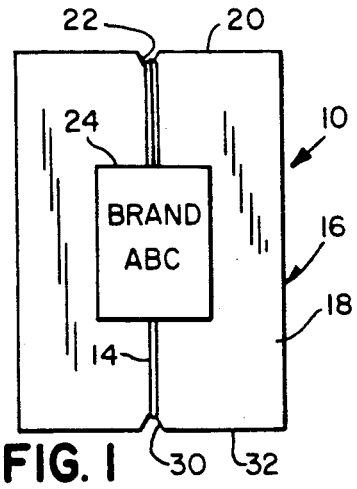
FIG. 1 is a front elevational view of the instant invention in a stored condition.
Figure 3:
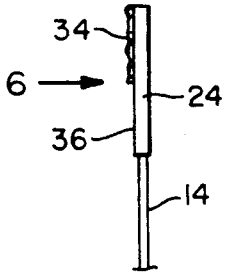
FIG. 3 is a side elevational view of the invention with the cover pulled up from the tea bag.
Figure 3:
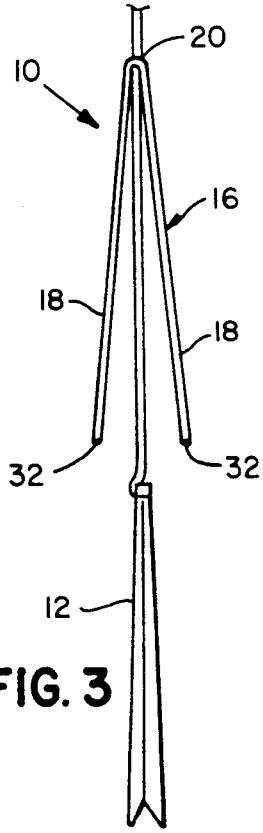
Figure 2:
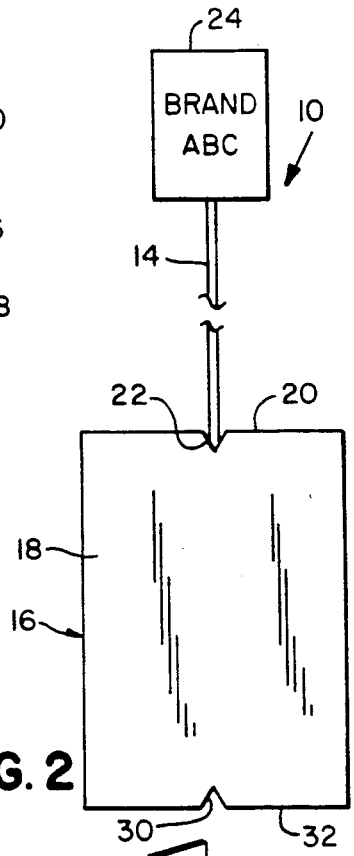
FIG. 2 is a front elevational view of the instant invention with the tag removed from the cover.
Figure 6:
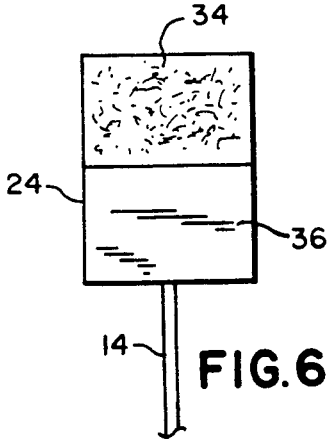
FIG. 6 is an enlarged rear elevational view of the tag taken in direction of arrow 6 in FIG. 3, showing adhesive thereon for captivating the string and holding the tag to the cover as illustrated in FIG. 1.

The hole 22 in the cover 16 is diamond shaped, while the cover 16 also has a V-shaped notch at the center of each free edge 32 of each panel 18 opposite the fold line 20. Reuseable pressure sensitive adhesive material 34 is applied to a portion of one side 36 of the tag 24, as shown in FIG. 6. When the cover 16 is slid downwardly on the string 14 onto the infusion bag 12, as shown in FIG. 1, the string 14 can wrap around the cover 16 in the notches 30 and the hole. The cover 16 will now serve as a protective structure for a fresh infusion bag 12 prior to use and as a disposable structure therefore after the infusion bag 12 is used.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A tea bag with a squeezing device comprising:

a) an infusion bag made of thermoseal filter paper capable of allowing water to filter therethrough, with a quantity of ground tea leaves sealed within said bag;

b) a string attached at one end to said bag;

c) a squeezing device consisting of a cover fabricated out of light, resilient polystyrene foam plastic sheet that will not absorb the liquid and which will insulate the fingers from said infusion bag when said bag is steaming hot and comprising two panels joined together along a fold line formed with a hole centrally located along said fold line and with the string passing through the hole; each said panel being of a size to completely fit over said infusion bag and wherein said cover has a V-shaped notch centrally located in the free edge of each of said panels, opposite said fold line;

d) a tag attached to the other end of said string such that said cover can slide on said string towards said tag thus allowing said infusion bag to be exposed from said cover and be inserted into a cup with water and said cover can slide on said string toward and onto said infusion bag allowing said panels to be used to squeeze said infusion bag therebetween to extract infusion from said bag; and e) reusable pressure sensitive adhesive material applied to a portion of one side of said tag; said tea bag with squeezing device being in its dry, stored, pre-use condition with said cover having been slid downwardly on said string and onto said infusion bag to completely cover said infusion bag in a protective arrangement; said string being wrapped around said cover and in said notches and said hole; said side of said tag having said pressure sensitive adhesive being positioned against said string, captivating said string and holding said tag to said cover; said pressure sensitive adhesive being sufficient to allow one to separate said tag and said adjoining string from said bag and to reposition said tag to again captivate said string and hold said tag to said cover to form a disposable structure after said infusion bag has been used.

* * * * *